US007199813B2

(12) United States Patent
Jacob

(10) Patent No.: US 7,199,813 B2
(45) Date of Patent: Apr. 3, 2007

(54) PHOTOGRAPHIC PRINTER USING HYPER-PIGMENT LOADED TONERS

(75) Inventor: Steve A Jacob, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 193 days.

(21) Appl. No.: 10/691,713

(22) Filed: Oct. 22, 2003

(65) Prior Publication Data

US 2005/0088511 A1 Apr. 28, 2005

(51) Int. Cl.
*B41J 2/435* (2006.01)
*G03G 15/08* (2006.01)

(52) U.S. Cl. ..... 347/228; 399/53

(58) Field of Classification Search ..... 347/228, 347/155–156, 158, 140, 151; 430/108.23, 430/99, 455, 44–45; 399/33, 68, 400, 53–65, 399/222–233, 178–181; 358/515
See application file for complete search history.

(56) References Cited

U.S. PATENT DOCUMENTS 5,025,292 A * 6/1991 Steele ..... 399/233
5,266,438 A 11/1993 Fuller et al. ..... 430/137.15
5,369,476 A 11/1994 Bowers et al. ..... 399/49
5,471,313 A 11/1995 Thieret et al. ..... 358/296
5,722,022 A 2/1998 Park ..... 399/284
5,841,458 A 11/1998 Kroon ..... 347/131
5,978,011 A 11/1999 Jacob et al. ..... 347/251
6,002,893 A 12/1999 Caruthers, Jr. et al. ..... 399/54
6,271,870 B1 8/2001 Jacob et al. ..... 347/156
6,448,994 B1 9/2002 Kim et al. ..... 347/228
6,892,038 B2 * 5/2005 Fukutani ..... 399/68
2002/0058193 A1 * 5/2002 Tosaka et al. ..... 430/108.23

FOREIGN PATENT DOCUMENTS

JP 2002123147 A * 4/2002

* cited by examiner

*Primary Examiner*—Hai Pham

(57) ABSTRACT

A set of color toners for use in an electrophotographic image forming device is disclosed. The set of color toners include a cyan toner having high cyan pigment load, a magenta toner having a high magenta pigment load, and a yellow toner having a high yellow pigment load. An electrophotographic image forming device includes the set of color high pigment load toners, a black toner, a controls system architecture for an electrophotographic process controller or image output terminal having a first setting to deliver a partial amount of color toners to a target media and having a second setting to deliver complete amount of color toners to said target media. A method of creating photographic and text images in an electrophotographic image forming device includes providing a set of color toners.

20 Claims, 8 Drawing Sheets

PHOTOGRAPHIC PRINTER USING HYPER-PIGMENT LOADED TONERS

TECHNICAL FIELD

The present invention relates to laser printers and toners for use in color laser printers and, in particular, to toners having increased pigment loading.

BACKGROUND OF THE INVENTION

Color laser printers utilize an electrophotographic process for recording and registering a multi-color image on an electrophotographic surface or a print medium, such as paper. Image data representing each primary color, such as those generated in a personal computer, are sent to the laser printer, which converts the image data to electrical signals that represent dots forming the image. Individual electrical signals modulate a laser beam as it is directed to an electrically charged, light-sensitive surface of a drum, which records the image pattern. The laser beam strikes and electrically discharges areas of the light sensitive drum to produce a latent electrostatic image on the drum surface. After it is scanned, the drum surface is positioned near a developing toner source, which is typically an electrically biased roller, to repel toner and thereby transferred to the drum surface to form a pattern that represents the image. The toner can be transported to the drum surface by dry carrier beads or suspended in a liquid vehicle. The toner is then transferred in accordance with an electrostatic process from the drum surface to the print medium.

Toner is a mixture of pigment and plastic (resin). A multi-color laser printer develops successive images by using developing toners of different colors supplied from corresponding toner sources. Color printing is typically done with the subtractive primary colors and with black. All of these colors are applied in registration during successive rotations of the drum before transfer of the toner to the print medium or the colors are applied to the print medium in registration by a series of in-line drums. Heat is applied (by passing the medium through a heater fuser) to permanently fuse the image to the print medium to form a finished multi-color image.

Laser driven color printers and copiers employ transparent toners which enable light to reflect off the page and to be directed back towards the eye. In general, such devices employ cyan (C), magenta (M) and yellow (Y) toners as the principal component colors, from which other colors are created. Light passing through CMY toners has part of its color filtered out or absorbed by the toner such that the reflected light takes on the color of the toners that it passes through. In laser printers (and some copiers), a black (K) toner is used which is opaque to light. Overall, more color and darker blacks mean a more photographic look to images. However, if a K toner is overprinted onto CMY to achieve darker colors, such as found in shadows, much of the colorfulness of the shadows is typically lost.

Alternatively, the prior art has employed combinations of the three primary colors CMY to produce darker colors ranging to black. Prior art printing procedures have also utilized combinations of K and CMY toners to achieve dark or shadowed color images. The need to deposit 100% density toner layers for each color (and, in some cases, black) typically causes an excessive amount of toner to be deposited on the media sheet. Such a high level of toner deposition does not fuse well and, in general, creates unsatisfactory images. Merely increasing the fusing time or temperature is not always feasible because of the differences in toners, media types, or excess heat that exists during fusing of the second side of a duplex page. Additionally, overfusing can cause media to curl, warp or jam the printer.

It would be desirable to provide toners that have improved chroma and darkness when printed on various media, while maintaining or improving the fusing, scattering, duplexing characteristics of the toners.

BRIEF SUMMARY OF THE INVENTION

A set of color toners for use in an electrophotographic image forming device is disclosed. The set of color toners include a cyan toner having high cyan pigment load, a magenta toner having a high magenta pigment load, and a yellow toner having a high yellow pigment load.

Also disclosed is an electrophotographic image forming device including a set of color toners having high pigment loads, a black toner having a black pigment, a controls system architecture for an electrophotographic process controller or image output terminal (IOT) having a first setting to deliver a partial amount of color toners to a target media and having a second setting to deliver complete amount of color toners to said target media.

A method of creating photographic and text images in an electrophotographic image forming device includes providing a set of color toners. The color toner set includes a toner having high cyan pigment load, a toner having a high magenta pigment load, and a toner having a high yellow pigment load. A black toner having black pigment is also provided. A first set of IOT settings to deliver a partial amount of color toners to a target media is provided along with a second set of settings to deliver a complete amount of color toners to the target media.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawing in which:

DETAILED DESCRIPTION OF THE INVENTION

Figure 1:
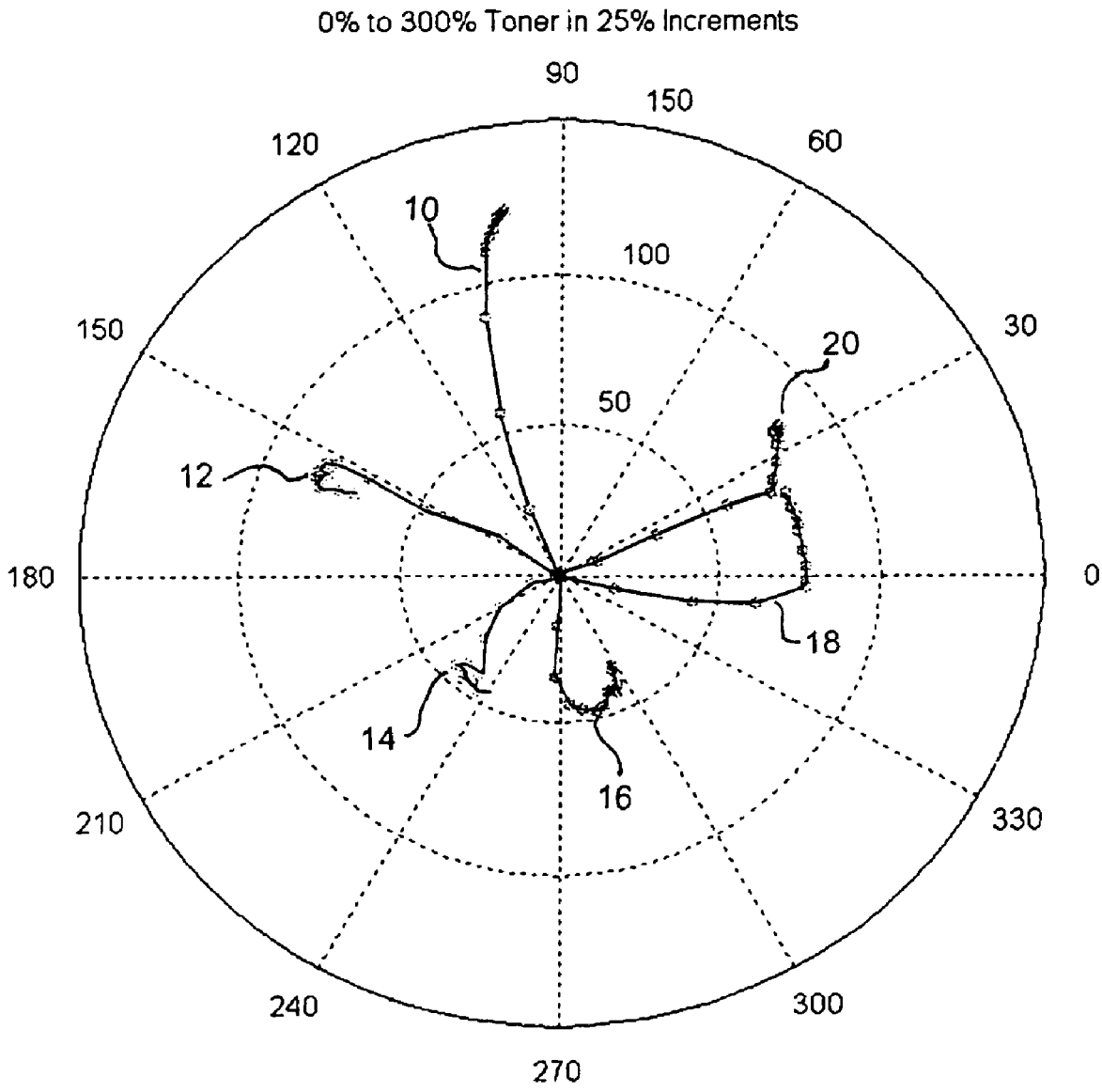
FIG. 1 illustrates an embodiment of the invention having a two-dimensional printer color space representing hue vs. chroma views of toner ramps for cyan, magenta, yellow, red, green, and blue.

Prior to describing the invention, a number of terms to be used hereafter will be defined. "Hue" defines a visual sensation according to which an area appears to be similar to one of a set of primary colors or to a combination of two of the primary colors. "Lightness" (or luminance) refers to the brightness of an area that is judged relative to the brightness of a similarly illuminated area that appears to be white or highly transmitting. "Chroma" relates to the colorfulness of an area. Although the present invention has been described with reference to a color laser printer, it will be understood by those of ordinary skill in the art that the present invention is equally applicable to other electrophotographic image forming devices such as photocopiers, facsimile machines and the like.

As used herein, the terms "high pigment load," "high pigment loading," "hyper pigment loaded," and "hyper-loaded pigment" means a toner having a greater than normal weight percent of pigment in relation to the total weight of a toner composition. For example, current toners available for most color laser printer applications typically contain pigment that is present in an amount of from 8 to 10 weight percent. In such an example, a high pigment loaded toner would contain in excess of 100 weight percent of the pigment typically used in such toners. Thus, where a toner typically includes 10 weight percent of a particular pigment, a high pigment load would include any suitable amount of pigment in excess of 10 weight percent.

One aspect of the present invention relates to a set of color toners for use in an electrophotographic image forming device. The set of color toners comprise a cyan toner having high cyan pigment load, a magenta toner having a high magenta pigment load, and a yellow toner having a high yellow pigment load. One particular embodiment of the present invention includes a set of color toners, wherein each color toner has a pigment load of greater than 16 weight percent. More preferably, the color toners have a pigment load of from about 20 weight percent to about 40 weight percent, with the most preferred embodiment having a pigment load of from about 24 weight percent to about 30 weight percent. The color toners of the present invention may have from greater than 100% to about 300% pigment loading, and more preferably from about 200% to about 300% pigment loading.

The set of color toners of the present invention may also include or be combined with a black toner. The black toner may include either black pigment or a high black pigment load. In an alternative embodiment, the set of color toners may include one or more toners each having a high pigment load of red pigment, blue pigment, or green pigment. It is understood that, while the invention is described with reference to various primary color toners and pigments, various toner hues may be selected by altering the pigment to be used.

Increasing the pigment loading in the toners of the present invention (hyper loading) causes the maximum density points of the toners to become darker and more chromatic. With use of the hyper loaded toners, two individual gamuts can be realized: 1) a standard toner gamut mode that matches the gamut achieved by use of non-hyperloaded toners (i.e., standard, commercially available toners having standard pigment loading); and 2) a photographic gamut mode having improved shadow colors that maintains or increases saturated and highlight colors observed in standard toner gamuts.

Due to the high pigment load of the toners of the present invention, less toner may be applied to a target media to achieve the same color advantages of a standard (non-hyperloaded) toner. Use of a reduced toner mass can lead to quicker fusing times in current electrophotographic image forming devices using standard fusers. In the photographic gamut mode, a standard amount of toner is applied, that is, the same mass of toner is applied (having excess pigment). Using the same amount enhances the color gamut in shadow areas, particularly when the target media coverage increases, such as with color photograph printing or copying. Gamut gains from the increased pigment loading and increased gloss create ink jet quality images. Printing of photographs with the hyperloaded pigment toners of the present invention, using a standard laser printer (Laserjet 4600, available from Hewlett-Packard), results in no additional scatter and normal duplexing.

Another aspect of the present invention relates to an electrophotographic image forming device that includes a set of color toners. The color toners that comprise a set of color toners each having a high pigment load, as previously described. The pigments can include a cyan pigment, a magenta pigment, a yellow pigment, or mixtures thereof. The pigments can alternatively or additionally be selected from the group consisting of red, blue, or green.

In a particular embodiment of the invention, a set of color toners can be prepared by respectively adding cyan, magenta, and yellow pigments to preexisting (non-hyperloaded) cyan, magenta, and yellow toners to create toners having high pigment loads. Preferably, sufficient amounts of cyan, magenta, and yellow pigments are used to increase the pigment loading for each color toner by about 1 to about 200 percent, thus creating or providing a set of color toners having from greater than 100% to about a 300% pigment load.

The device may further include a black toner that may contain either black pigment or a high black pigment load. A controls system architecture for an IOT is also provided, which includes a first setting to deliver a partial amount of color toners to a target media, such as for color office graphics printing or black-and-white text printing, and a second setting to deliver complete amount of color toners to said target media, such as for color photographic image printing applications. For example, if it is assumed that the color toners have a pigment load of 200%, then the amount of color toner may be reduced by 50% to obtain the same or an equivalent amount of color pigment on the target media. For darker and more chromatic images, application of the second setting would deliver 100% of the 200% pigment loaded color toners. The first set of image output terminal settings may also increase the speed and/or temperature of a fuser roller as well as any other settings in an electrophotographic image-forming device.

Yet another aspect of the present invention relates to a method of creating photographic and text images in an electrophotographic image forming device with a set of hyperloaded pigment color toners. The color toner set includes a toner having high cyan pigment load, a toner having a high magenta pigment load, and a toner having a high yellow pigment load. A black toner having black pigment may also be provided. A first set of IOT settings to deliver a partial amount of color toners to a target media is provided along with a second set of IOT settings to deliver a complete amount of color toners to the target media. The first set of IOT settings may also increase the speed of a fuser roller in the electrophotographic image forming device allowing for a higher number of pages per minute to be printed.

Any controls system architecture known to those having skill in the art can be used in conjunction with the present invention to control the IOT during a printing or copying process. Suitable machine control systems for document reproduction apparatus are known in many forms, such as for example mechanical systems of levers, gears, cams, rollers, and/or belts to transmit signals required to sequence or time system functions. Such control systems include, but are not limited to mechanical systems, pneumatic systems, hydraulic systems, electrical or electronic machine control systems (that use various sensors, switches, motors, solenoids, and clutches interconnected by wires or other electrically conductive means), and electro-optical systems (which employ fiber optic light conductors to transmit signals to and from the functional elements in the system).

The toners of the present invention in embodiments thereof are comprised of resin particles, pigment particles, such as known carbon blacks, including those available from Cabot Corporation, such as REGAL 330® carbon black, colored pigments other than black such as magenta, cyan, yellow, or mixtures thereof, and typically include a known charge additive, such as, for example, those comprised of the hydroxy aluminum complexes of alkylated salicylic acids.

Pigments for use in the present invention are also well known in the art and are commercially available from sources, such as BASF, Cabot Corp., CIBA, Clariant, Degussa, DuPont, Heubach, and Mobay Chemical Corp. The pigment may include, but is not limited to, the following pigments available from BASF: Paliogen® Orange, Heliogen® Blue L 6901F, Heliogen® Blue NBD 7010, Heliogen® Blue K 7090, Heliogen® Blue L 7101F, Paliogen® Blue L 6470, Heliogen® Green K 8683, and Heliogen® Green L 9140. The following black pigments are available from Cabot: Monarch® 1400, Monarch®1300, Monarch® 1100, Monarch® 1000, Monarch® 900, Monarch® 880, Monarch® 800, and Monarch® 700. The following pigments are available from CIBA: Chromophtal® Yellow 3G, Chromophtal® Yellow GR, Chromophtal® Yellow 8G, Igrazin® Yellow 5GT, Igralite® Rubine 4BL, Monastral® Magenta, Monastral® Scarlet, Monastral® Violet R, Monastral® Red B, and Monastral® Violet Maroon B. Other suitable pigments available from Degussa include: Printex U, Printex V, Printex 140U, Printex 140V, Color Black FW 200, Color Black FW 2, Color Black FW 2V, Color Black FW 1, Color Black FW 18, Color Black S 160, Color Black S 170, Special Black 6, Special Black 5, Special Black 4A, and Special Black 4. The following pigment is available from DuPont: Tipure® R-101. Suitable pigments available from Heubach include: Dalamar® Yellow YT-858-D and Heucophthal® Blue G XBT-583D. Suitable pigments available from Clariant include: Permanent Yellow GR, Permanent Yellow G, Permanent Yellow DHG, Permanent Yellow NCG-71, Permanent Yellow GG, Hansa Yellow RA, Hansa Brilliant Yellow 5GX-02, Hansa Yellow-X, Novoperm® Yellow HR, Novoperm® Yellow FGL, Hansa Brilliant Yellow 10GX, Permanent Yellow G3R-01, Hostaperm® Yellow H4G, Hostaperm® Yellow H3G, Hostaperm® Orange GR, Hostaperm® Scarlet GO, and Permanent Rubine F6B. Pigments available from Mobay include: Quindo® Magenta, Indofast® Brilliant Scarlet, Quindo® Red R6700, Quindo® Red R6713, and Indofast® Violet. Pigments available from Sun Chemical include: L74-1357 Yellow, L75-1331 Yellow, and L75-2577 Yellow. Pigments available from Columbian include: Raven 7000, Raven 5750, Raven 5250, Raven 5000, and Raven 3500.

Examples of thermoplastic resins suitable for use with the present invention include, but are not limited to, ethylene vinyl acetate (EVA) copolymers, (ELVAX® resins, E.I. DuPont de Nemours and Company, Wilmington, Del.); copolymers of ethylene and an a-b-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURALO (Union Carbide Corporation, Stamford, Conn.; ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); copolymers of ethylene and an a-b-ethylenically unsaturated acid of either acrylic acid or methacrylic acid; NUCREL® resins available from E.I. DuPont de Nemours and Company (e.g., NUCREL 599®, NUCREL 699®, or NUCREL 960®; or blends thereof.

EXAMPLES

The following examples are detailed descriptions of methods of using and testing the hyper pigment loaded toners of the present invention. The detailed descriptions fall within the scope of, and serve to exemplify, the more general descriptions set forth above. The examples are presented for illustrative purposes only and are not intended as restrictions on the scope of the invention.

Example 1

Hyper Pigment Loaded Toner Gamut Ranges

Hue versus chroma characteristics for hyper pigment loaded toners were simulated by printing and fusing paper media with patches containing up to 300% primary toners. Specifically, cyan, magenta, yellow, red, green, and blue toners were printed and fused using the cardstock mode. Hewlett-Packard glossy paper was used with a normal cardstock fusing temperature. Toner concentrations of 0% to 300% in 25% increments. Toner concentrations of 125% to 300% were simulated by repeatedly printing and fusing the receptive paper media. For example, the 300% point was simulated by printing the target media with 100% of a selected toner, followed by fusing, and repeating the printing and fusing steps two subsequent times. The 150% point was simulated by printing the target media with 100% of a selected toner, followed by fusing, and a separate printing of the target media with 50% of the toner, followed by a final fusing step.

FIG. 1 shows measurements of the primary and secondary ramp transitions from white to the 300% point in the 25% increments tested. Yellow toner ramp 10 demonstrates an increase in chroma with increased toner concentration, while substantially maintaining a yellow hue. Green toner ramp 12 demonstrates a loss in chroma with increased toner concentration with an increase in darkness, while dramatically increasing gamut. Cyan toner ramp 14 also demonstrates an increase in darkness with increased toner concentration. Blue toner ramp 16 shows a large hook representing a loss in chroma, but also shows increased darkness and gamut with increased toner concentration. Magenta toner ramp 18 demonstrates a shift toward a red hue with increased toner concentration. Red toner concentration 20 demonstrates a slight shift in hue and a proportionally reduced increase in chroma as the toner concentration is increased beyond 100%.

Figure 2:
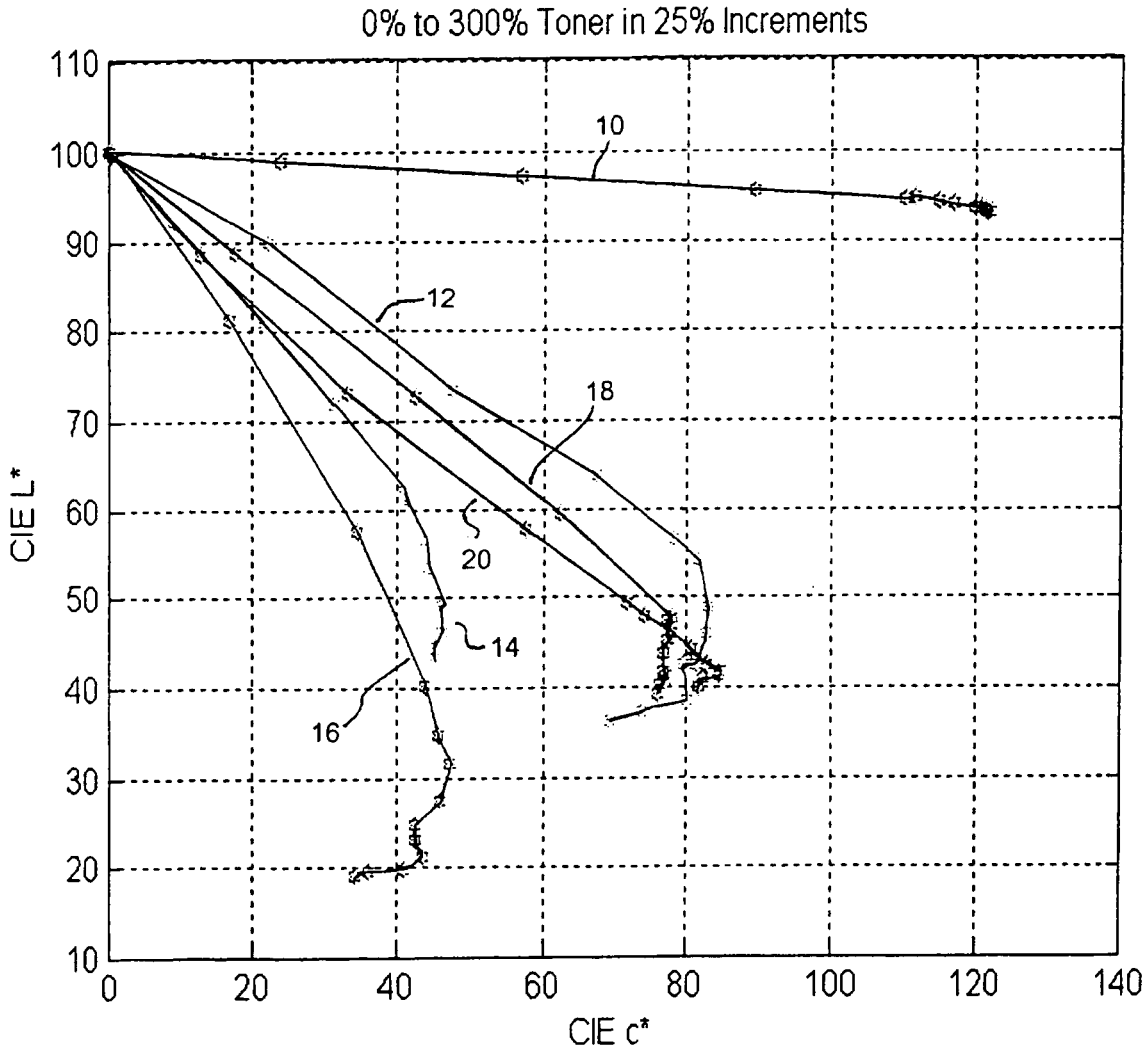
FIG. 2 is a chart illustrating lightness vs. chroma of color ramps for the colors of the embodiments of the invention of FIG. 1.
Figure 3:
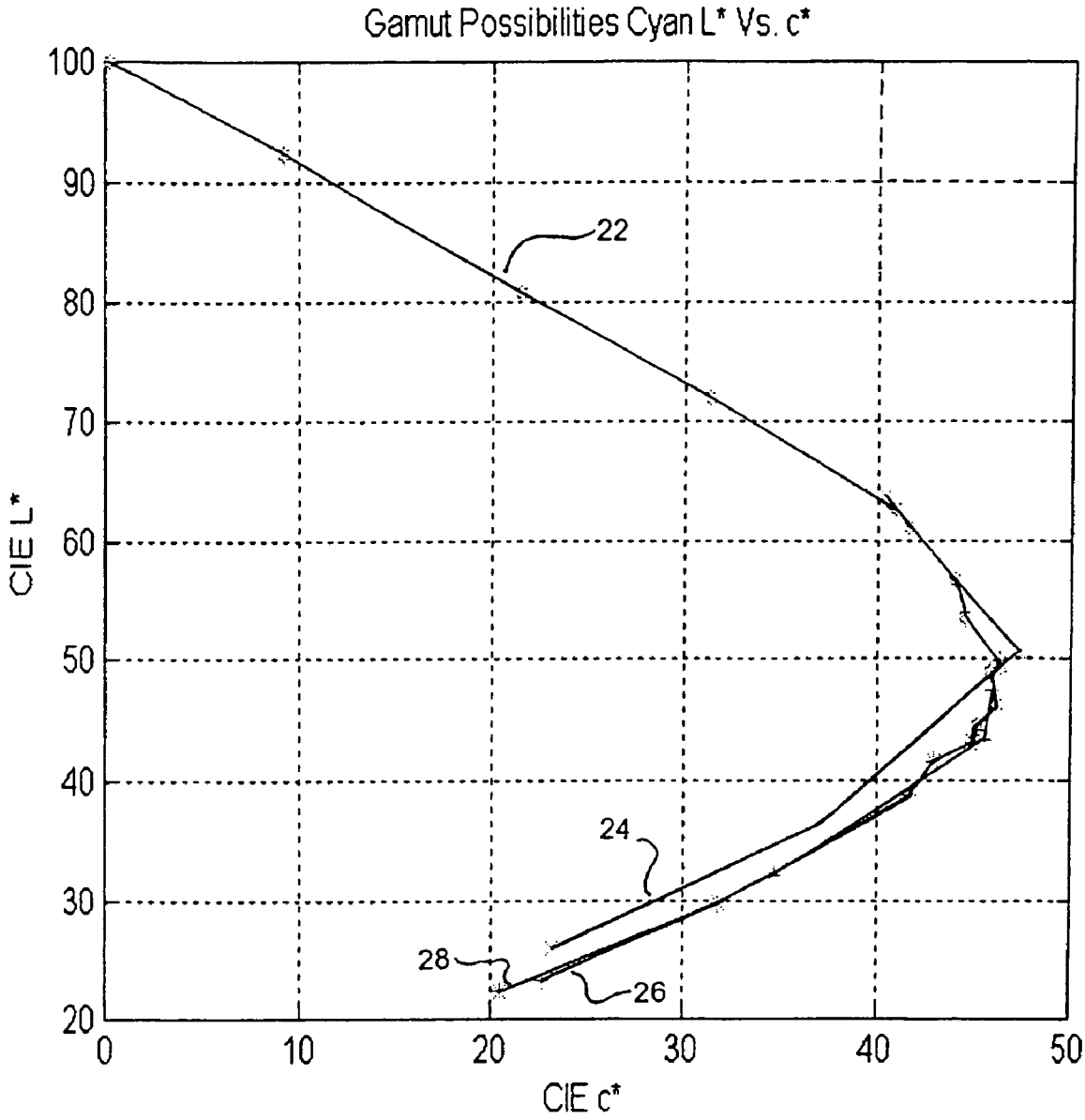
FIGS. 3 through 8 are charts illustrating embodiments of the invention, specifically each of the individual color ramps of FIG. 2 extended from the 100%, 200% and 300% pigment points to black.
Figure 4:
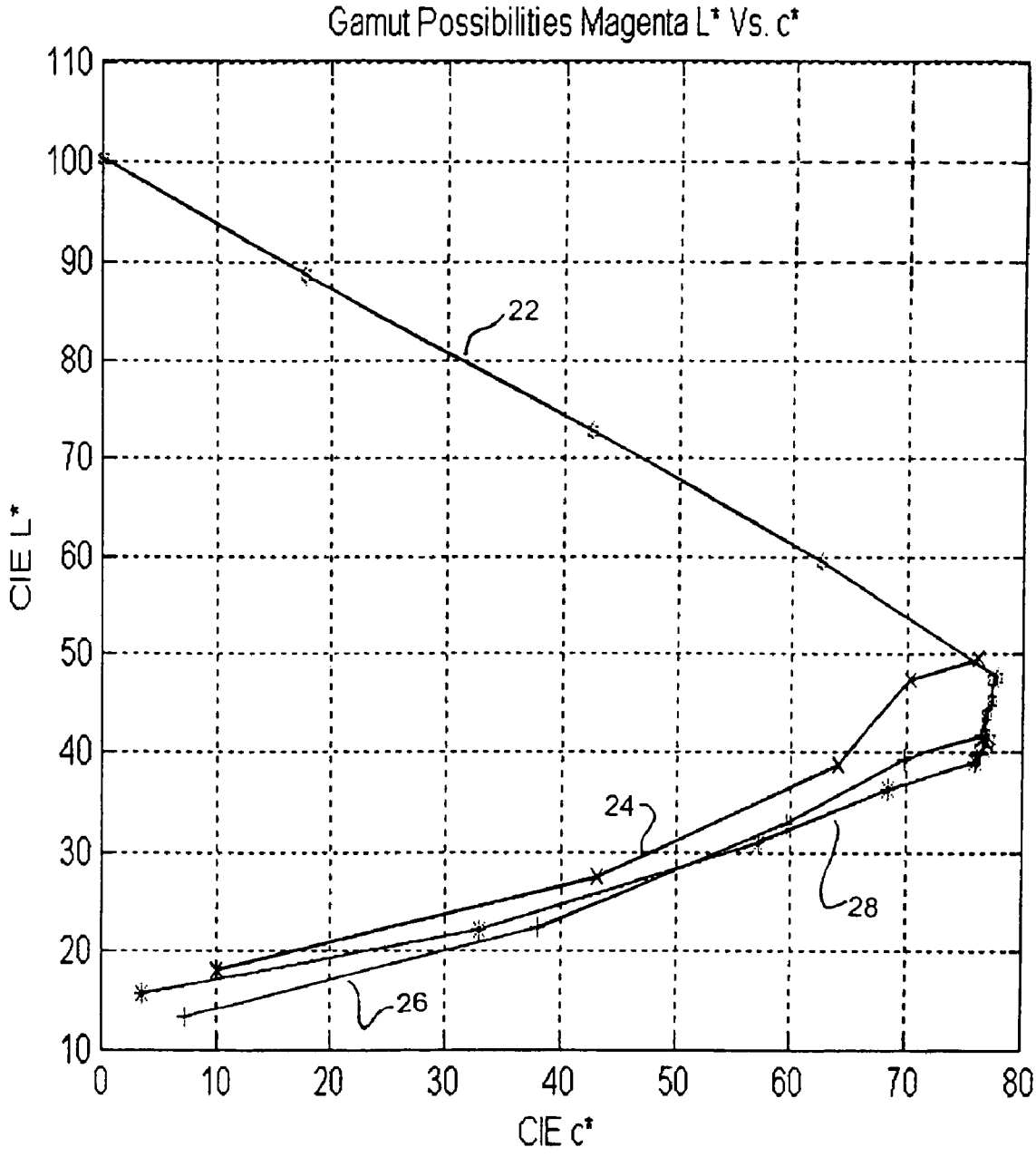
Figure 5:
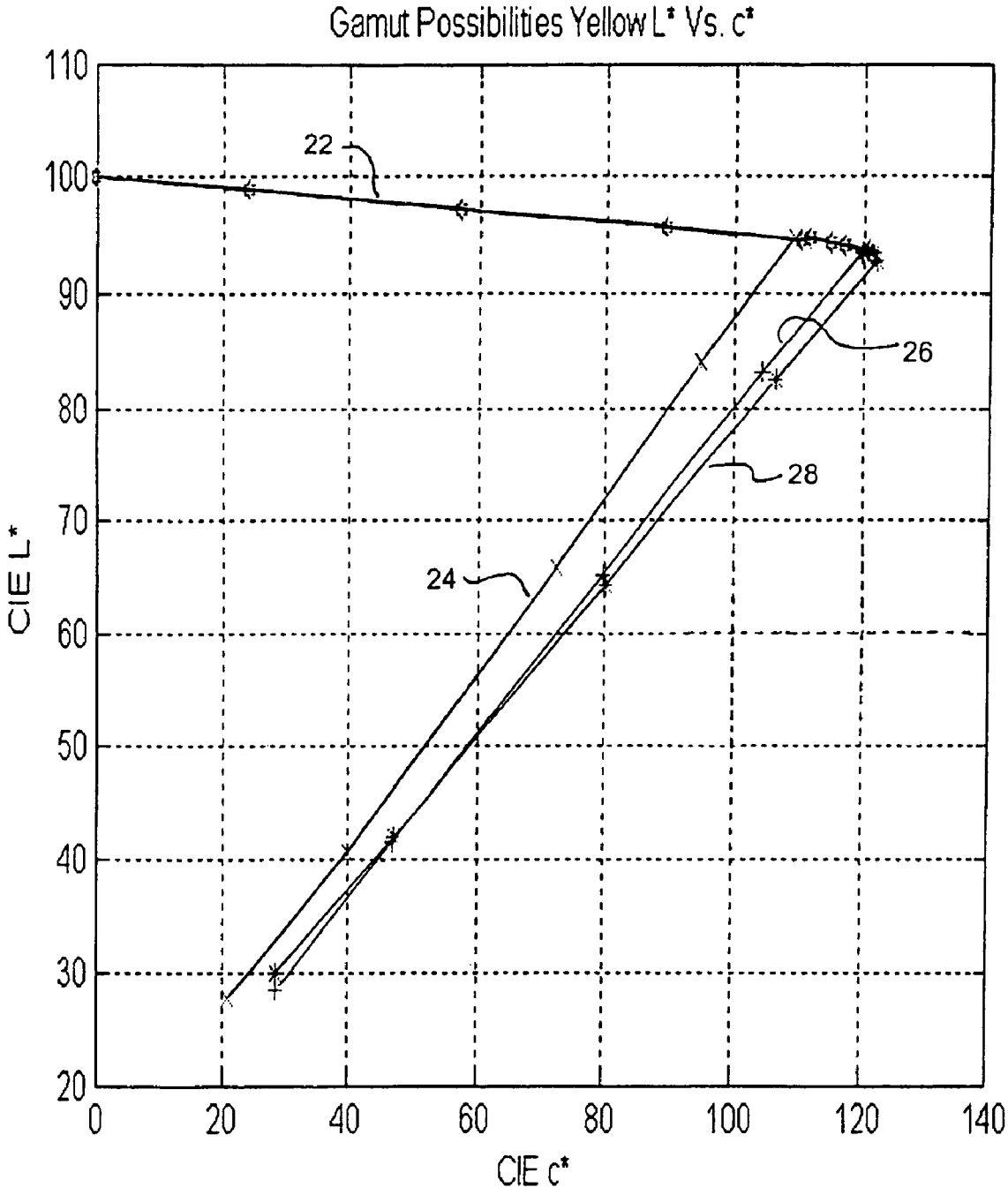
Figure 6:
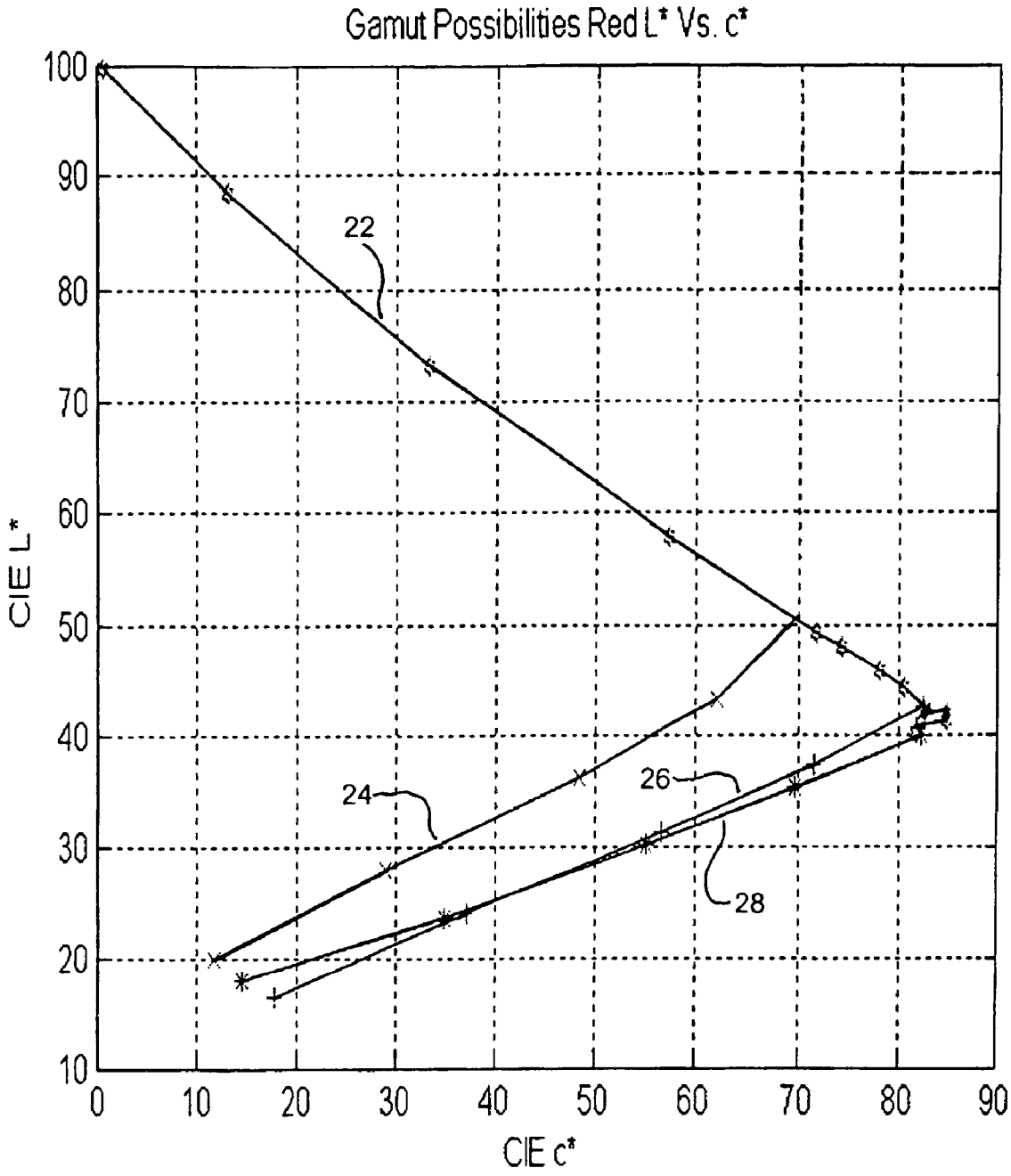
Figure 7:
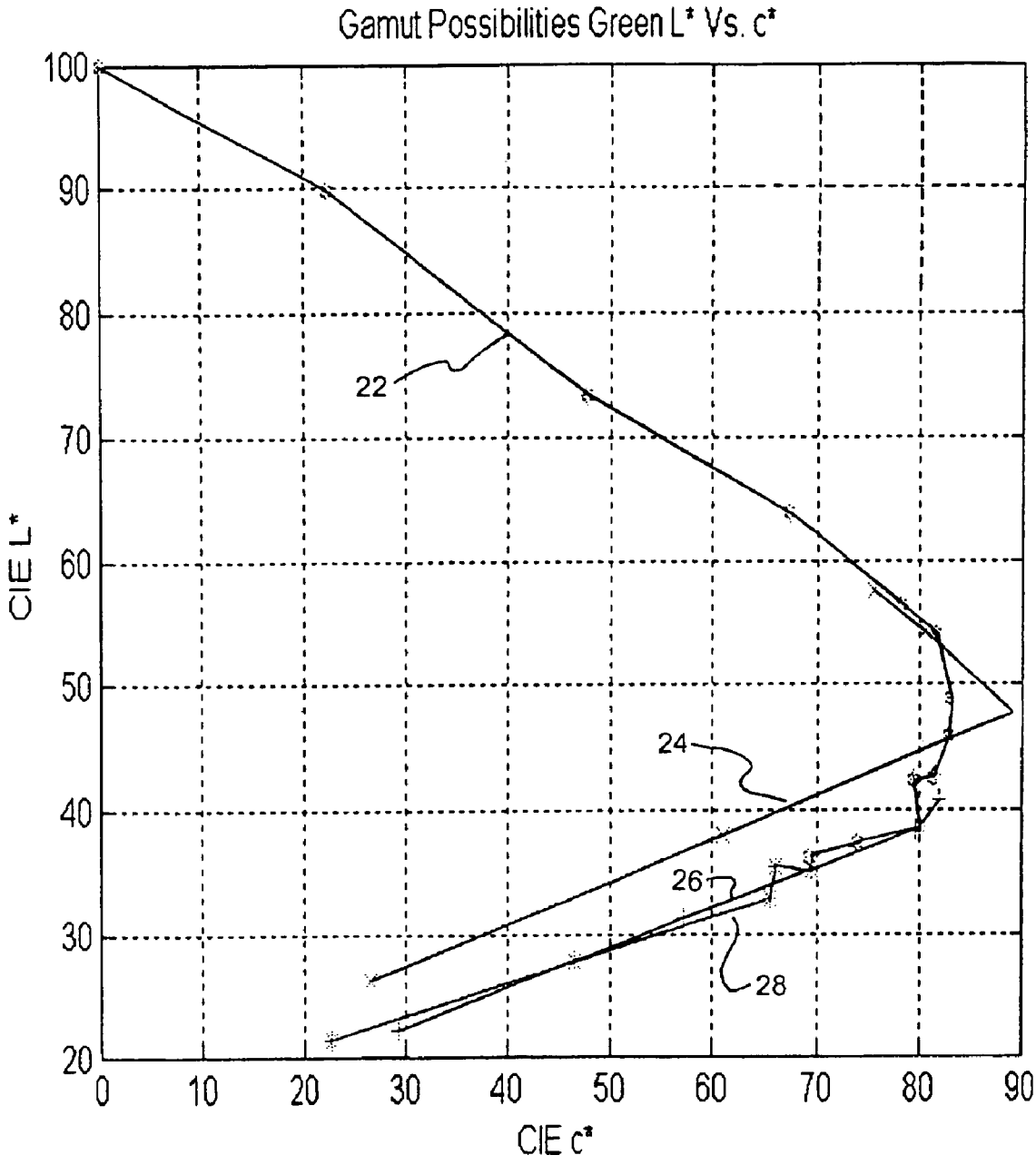
Figure 8:
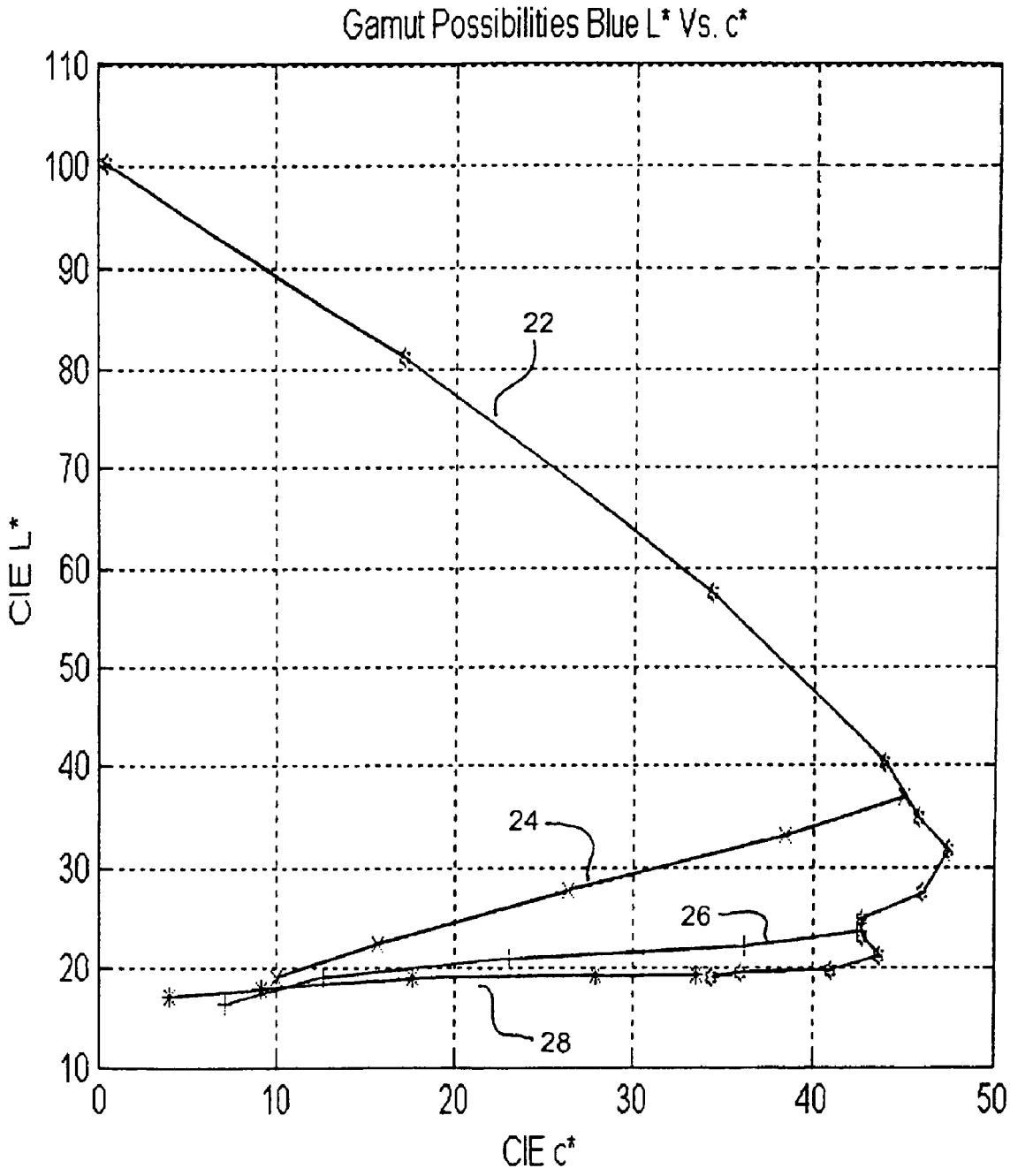

FIG. 2 shows the same test results described with reference to FIG. 2, but illustrates the measured lightness (L*)

versus chroma (c*) of the 0% to 300% toner ramps for the cyan, magenta, yellow, red, green, and blue toners tested. Generally, it can be observed that the toner ramps begin to hook backwards to the black point when toner concentration is increased. This represents the best theoretical gamut that can be achieved with the tested color toners in electrophotographic image forming devices. By continuing the trajectory to the black point, which is accomplished through addition of K toner, a gamut outline of each color toner can be created that encloses the largest color volume. Such chromatic dark colors are desirable for realistic photo reproduction.

With reference to FIG. 2, yellow toner ramp 10 demonstrates an increase in chroma with a slight increase in darkness when toner concentration is increased. Green toner ramp 12 demonstrates an overall increase in chroma (up to about CIE c* of 83) with a resultant increase in darkness as toner concentration is increased. Cyan toner ramp 14 and blue toner ramp 16 remain very chromatic while transitioning toward black as toner concentration is increased. Magenta toner ramp 18 loses some lightness (resulting in a shift toward a red hue) as toner concentration increases beyond the 100% point. Red toner concentration 20 reaches its most chromatic point at a CIE c* of about 85.

Example II

Color Ramp Extensions to Black

Lightness versus chroma characteristics for the cyan, magenta, yellow, red, green, and blue toners were tested by extending each color ramp (represented by reference number 22) from the 100% pigment point (represented by reference number 24), 200% pigment point (represented by reference number 26), or 300% pigment point (represented by reference number 28) to black (i.e., CIE L* approaching a value of 0), as illustrated in FIGS. 3 through 8. Specifically, K pigment was incrementally added to toners containing 100%, 200%, or 300% pigment loads and spectrophotometrically measured for chroma and lightness to determine potential increases in shadow color gamut that can be achieved with hyper pigment loaded toners. As generally shown in FIGS. 3 through 8, toners having a pigment load of 200% (26) and 300% (28) showed significant increases in shadow color gamut. Gamut gains can be achieved for each of the cyan, magenta, yellow, red, green, and blue toners tested at the 200% (26) and 300% (28) pigment loads. More specifically, darker colors (lower CIE L*) can be achieved with each of the 200% (26) and 300% (28) pigment loaded color toners without losing chroma. Stated differently, more chromatic colors (higher CIE c*) can be achieved with each of the 200% (26) and 300% (28) pigment loaded color toners without increasing lightness (i.e., decreasing darkness) of the toner.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method of creating photographic and text images in an electrophotographic image-forming device, comprising:

providing a set of color toners, said set comprising a toner having high cyan pigment load, a toner having a high magenta pigment load, and a toner having a high yellow pigment load;

providing a black toner having black pigment;

providing a first set of image output terminal settings to deliver a partial amount of color toners to a target media and to increase a speed of a fuser roller in said electrophotographic image-forming device; and providing a second set of image output terminal settings to deliver a complete amount of the same color toners previously partially delivered to said target media.

2. The method of claim 1, wherein said set of color toners further comprises one or more toners each having a high pigment load selected from the group consisting of red pigment, blue pigment, or green pigment.

3. The method of claim 1, wherein said set of color toners have a pigment load of greater than 20 weight percent.

4. The method of claim 1, wherein said set of color toners have a pigment load of from about 24 weight percent to about 30 weight percent.

5. The method of claim 1, wherein providing a set of color toners comprises respectively adding cyan, magenta, and yellow pigments to cyan, magenta, and yellow toners.

6. The method of claim 5, wherein sufficient amounts of cyan, magenta, and yellow pigments are added to said set of color toners to increase the pigment loading for each said color toner by about 1 to about 200 percent.

7. The method of claim 5, wherein sufficient amounts of cyan, magenta, and yellow pigments are added to said set of color toners to increase the pigment loading for each said color toner by from about 100 to about 200 percent.

8. The method of claim 1, further comprising transferring at least one said color toner to said target media.

9. The method of claim 8, further comprising transferring said black toner to said target media.

10. The method of claim 1, wherein said target media comprises paper.

11. An electrophotographic image-forming device comprising:

a cyan toner having high cyan pigment load;

a magenta toner having a high magenta pigment load;

a yellow toner having a high yellow pigment load; and an image output terminal having a first setting to deliver a partial amount of color toners to a target media and to increase a speed of a fuser roller in said electrophotographic image-forming device, and having a second setting to deliver a complete amount of the same color toners previously partially delivered to said target media.

12. The device of claim 11, further comprising one or more toners each having a high pigment load selected from the group consisting of red pigment, blue pigment, or green pigment.

13. The device of claim 11, wherein each of said cyan, magenta, and yellow toners have a pigment load of greater than 20 weight percent.

14. The device of claim 11, wherein each of said cyan, magenta, and yellow toners have a pigment load of from about 40 weight percent to about 60 weight percent.

15. The device of claim 11, further comprising a black toner having a black pigment.

16. An electrophotographic image-forming device comprising:

a set of color toners having high pigment loads;

a black toner having a black pigment; and an image output terminal having a first setting to deliver a partial amount of color toners to a target media and to increase a speed of a fuser roller in said electrophotographic image-forming device, and having a second setting to deliver complete amounts of the same color toners previously partially delivered to said target media.

17. The device of claim 16, wherein said pigment is selected from the group consisting of cyan, magenta, yellow, or mixtures thereof.

18. The device of claim 16, wherein said pigment is selected from the group consisting of red, blue, or green.

19. The toner set of claim 16, wherein said color toner set has a pigment load of greater than 20 weight percent.

20. The toner set of claim 16, wherein said color toner set has a pigment load of from about 24 weight percent to about 30 weight percent.

* * * * *